United States Patent [19]

Astrupgaard et al.

[11] Patent Number: 4,471,707

[45] Date of Patent: Sep. 18, 1984

[54] THREAD CUTTING DEVICE FOR SEWING MACHINES

[75] Inventors: Svend Astrupgaard, Lyngby; Ernst K. Krusholt, Greve Strand; Morgens Poulsen, Ishoj, all of Denmark

[73] Assignee: Pfaff Industriemaschinen GmbH, Fed. Rep. of Germany

[21] Appl. No.: 556,562

[22] Filed: Nov. 30, 1983

[30] Foreign Application Priority Data

Dec. 4, 1982 [DE] Fed. Rep. of Germany ..... 3244996

[51] Int. Cl.[3] ..... D05B 65/02

[52] U.S. Cl. ..... 112/292; 112/301

[58] Field of Search ..... 112/292, 301, 291, 295, 112/298, 300

[56] References Cited

U.S. PATENT DOCUMENTS 3,173,392 3/1965 Hedegaard ..... 112/292
3,386,402 6/1968 Ross ..... 112/292
3,782,313 1/1974 Centi ..... 112/301
4,254,725 3/1981 Hager et al. ..... 112/301 X

*Primary Examiner*—H. Hampton Hunter
*Attorney, Agent, or Firm*—McGlew and Tuttle

[57] ABSTRACT

A thread catcher of a cutting device in sewing machines is actuated by an air cylinder whose piston has two portions of unequal diameter. The small cylinder space accommodating the smaller-diameter piston portion is permanently pressurized while the larger cylinder space is alternately pressurized and vented. The larger cylinder space portion on its end closer to the smaller piston portion is permanently vented through a conduit. Both this conduit and the conduit for supplying the larger cylinder space include a throttle. The obtained effect is that the first step of motion of the thread catcher is quick and exact in duration, while the second step of motion is slower but performed with a greater force, so that thin threads are prevented from tearing prematurely and thick threads are cut reliably.

5 Claims, 3 Drawing Figures

THREAD CUTTING DEVICE FOR SEWING MACHINES

FIELD AND BACKGROUND OF THE INVENTION

This invention relates in general to sewing machines and in particular to a new and useful thread cutting mechanism.

A thread cutting device is disclosed in German utility model 79 12 758. In this prior art device, a spring acts on the piston rod of the air cylinder by which the first step of motion of the thread catcher is supported and the opposite second step of motion is braked. The spring helps to overcome starting resistances while executing the first step of motion which may occur especially after a longer standstill. During the second step of motion, the spring reduces the speed of the thread catcher insofar as even thin threads can be pulled out without a risk of tearing and moved to the counter-knife, and satisfactory cutting is effected even under adverse conditions. The thread catcher is further equipped with a second air cylinder whose piston rod, with the thread catcher standing still, engages an opening of a member which is connected to the piston rod of the first air cylinder, thereby preventing the spring from pulling the thread catcher into the path of motion of the needle in instances of an air supply failure.

However, a satisfactory operation of the thread catcher requires additional, considerably expensive equipment, namely, aside from the spring, an adjusting device for presetting the spring tension, and the second air cylinder. Even more expensive is the mounting, since the initial tension of the spring must be adjusted as a function of the respective spring rate, and the position of the second air cylinder must exactly correspond to the mounted position of the first air cylinder, to enable it to perform its retaining function.

SUMMARY OF THE INVENTION

The present invention is directed to a simplified design of a thread catcher, also facilitating and accelerating the assembly and mounting.

The use of a piston having two portions of unequal diameters makes it possible to provide a permanent pressurizing of the smaller cylinder space, and to alternately pressurize and vent only the larger cylinder space. Experience has shown that with a permanently pressurized smaller cylinder space and quick venting of the larger cylinder space at a start of the first sign of motion, neither appreciable delays in starting the motion, nor longer periods of standstill are caused.

Due to the providing of a throttling section in the conduit for supplying the large cylinder space and/or in the conduit for permanently venting the larger cylinder space, either the pressure build-up in the larger cylinder is retarded, or an air cushion braking the motion of the piston is produced at the side close to the smaller piston portion of the larger cylinder space. Preferably, a throttling section is provided in both of the conduits. Consequently, the piston speed reduction during the second step of motion needed for a satisfactory function of the thread cutter is obtained by simple pneumatic means alone. Since the cross-sectional area of flow of the throttling passages can be kept within narrow tolerances, with the results, under an assumed constant pressure, of obtaining with different air cylinders always identical flow conditions, no initial adjustment is necessary, in contradistinction to prior art thread cutters where such an adjustment is inevitible because of the varying stiffness of springs.

Upon a pressure failure, the piston stops in its rest position, since, except for the pressure exerted by the compressed air, no other forces act on the piston in rest position. That is why no additional air cylinder retaining the thread catcher is needed in the inventive thread cutting device.

As soon as the surface ratio of the larger to the smaller piston portion exceeds 2 to 1, the piston exerts a stronger force during the second step of motion than during the first step of motion, in spite of the lower speed. This makes sure that even thick threads are reliably cut.

Due to the provision of a damping piston adjacent the piston portion of larger diameter, which is associated with a damping bore adjacent to the cylinder space, the piston is braked at the end of the first step of motion, so that it is prevented from butting hard against the front face of the air cylinder.

The feature of a combined air cylinder and directional valve further simplifies the mounting of the thread cutter, since the otherwise needed flexible tube connections between the valve and the air cylinder are saved. The short communication paths between the valve and the air cylinder reduce the response time and also increases the timing accuracy of the individual switching operations.

The arrangement and design of the directional valve between the conduit for supplying the larger cylinder space and a venting bore, and that the valve piston is provided with sealing fromt surfaces for alternately closing the supply conduit and the venting bore, and with at least one flow channel extending the entire length of the valve piston is a particular simplification, so that a 3/2 directional valve can be employed, requiring actuation with external energy only in one direction, thus, with an electromagnetic actuation, a single effective coil.

Accordingly, it is an object of the invention to provide an improved mechanism for effecting the severing thread in a sewing machine.

A further object of the invention is to provide a mechanism for severing thread in a sewing machine which includes an actuator for moving the thread catcher so that a first step of motion is effected in a rapid and exact manner and a second step is slower but performs greater force.

A further object of the invention is to provide a device for cutting thread in a sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
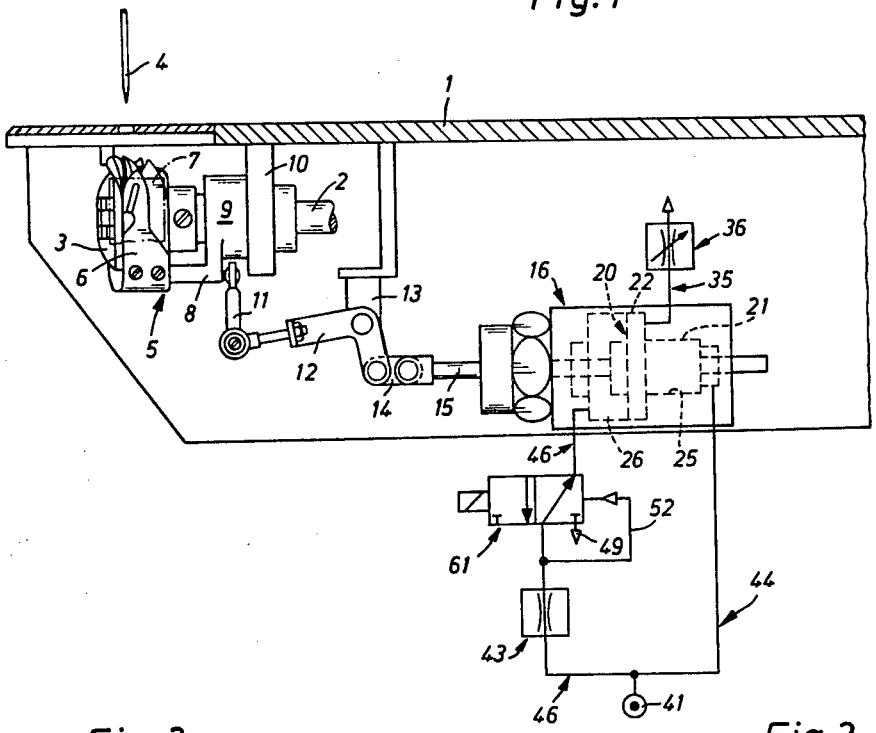
FIG. 1 is a partial vertical sectional view of a sewing machine with a simplified schematic of the pneumatic control constructed in accordance with the invention.
Figure 3:
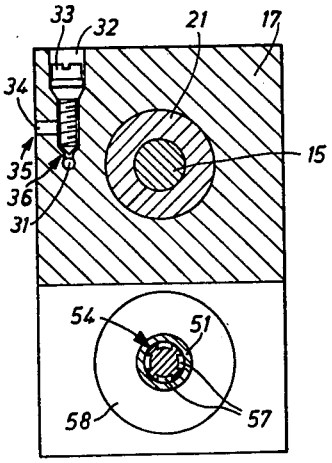
FIG. 3 is a section taken along the line III—III of FIG. 2.

Referring to the drawings in particular the invention embodied therein comprises a thread cutting device for a sewing machine, the plate of which 1 is shown in FIG. 1 over which a needle 4 reciprocates. The thread cutting device includes a thread catcher 6 which includes a thread cutter 5 having a support arm which is movable to present the thread to a knife 7 and which is actuated by a mechanism generally designated 16. The mechanism 16 is moved by a piston rod 15 acting through a linkage mechanism and the piston is moved so that the thread cutter executes a first step of motion to take hold of the threads and a second step of motion in an opposite direction to pull the threads out and move them to the fixed knife 7. Piston rod 15 is actuated by a double acting air cylinder which has a large diameter portion 26 and a small diameter portion 25 and a piston movable therein having a large diameter portion in the large diameter portion of the cylinder and a smaller diameter portion in the smaller diameter portion of the cylinder. The piston is movable so as to effect the first step of motion and the smaller diameter portion of the piston and the larger diameter portion is actuated by pressure fluid to effect the second step of motion. For this purpose the large diameter portion of the cylinder is vented on its end adjacent the small diameter portion thereof and means are provided for pressurizing and venting the large diameter portion of the cylinder on its end opposite to the small diameter portion. The means for alternately pressurizing and venting the large diameter space 26 includes a conduit 35 having a throttling element 43 therein.

FIG. 1 shows the base plate 1 of a sewing machine below which the horizontal shaft 2 for driving the rotary hook 3 is mounted. The rotary hook is secured to the forward end of shaft 2 and cooperates with a needle 4 which is moved up and down by a needle bar (not shown).

Beneath base plate 1, a thread cutter 5 is provided which is designed and operates as described in German Pat. No. 1,125,742. Thread cutter 5 comprises a thread catcher 6 which is mounted coaxially of the rotary hook 3 and cooperates with a knife 7 secured to the underside of the base plate 1. The thread catcher 6 is secured to a supporting arm 8 which is connected to a ring 9 loosely embracing a hook drive shaft 2. Ring 9 is secured against axial displacement and rotatable in an annular track 10 which is secured below base plate 1. Hinged to the supporting arm 8 is a link 11 which is connected to one arm of an angle lever 12 carried by a bracket 13 which is fixed to the housing. The other arm of the angle lever 12 is connected through a link 14 to the piston rod 15 of an air cylinder 16.

Air cylinder 16 comprises a housing or casing 17 having a front wall 18 and a screwable cover 19. Piston rod 15 extends through cover 19 and front wall 18 and carries a piston 20. The piston 20 comprises a small diameter piston portion 21 having a smaller diameter than a large diameter piston portion 22 having a larger diameter. The effective surface of the larger piston portion 22 is more than twice the front face area of the smaller piston portion 21, so that the surface ratio is greater than 2 to 1. Frontally adjacent to the larger piston portion 22 is a damping piston 23 having a smaller diameter than portion 22 and being provided, on its circumference, with a lengthwise extending notch 24. Within case 17, a small cylinder space 25 associated with the smaller piston portion 21 a large cylinder space 26 associated with the larger piston portion 22, and a damping bore 27 associated with damping piston 23 are formed.

A radial bore 29 opens into a vestibule 28 of the cylinder space 25, and an obliquely extending bore 30 opens into cylinder space 26. Further, an axial bore 31 extends from cylinder space 26 to a vertical bore 32 for receiving a screw 33. From bore 32, a cross bore 34 extends to the ambient atmosphere. Bores 31 and 34 form a conduit 35 in which a throttling valve 36 comprising bore 32 and screw 33 is provided.

Secured to casing 17 are two attachments 37 and 38. Attachment 37 is provided with a bore 39 which is aligned with the bore 29. The bore 39 opens into a bore 40 extending crosswise thereto and is connected, at one side, to a compressed air source 41 indicated in FIG. 1, and changes, at the other side, into a narrow bore 42. Bore 42 forms a throttle 43, while bores 29,39,40 form a conduit 44.

Attachment 38 is provided with an oblique bore 25 which is aligned with bore 30. Bore 45 opens into a chamber 48 which is closed by a funnel-shaped wall 47. A bore 49 is provided in wall 47, through which chamber 48 communicates with the ambient atmosphere. In front of bore 47 a disc 50 of sintered metal is secured, serving as a sound absorber.

Screwed into attachment 38 is a cylindrical valve casing 51 which is provided with a bore 52 aligned with bore 42, and with a valve chamber 53 which opens into chamber 48. Bores 42, 52, 45 and 30 and valve chamber 53 form together a conduit 46. Valve chamber 53 accommodates a valve piston 54 whose two front faces 55,56 form sealing surfaces. On the circumferential surface of valve piston 54, four grooves 57 are provided extending axially the entire length of the piston. Valve casing supports an electromagnet 60 comprising a housing 58 and a coil 59, with valve piston 54 operating as the armature. Attachment 38, valve casing 51 with valve piston 54, and electromagnet 60 form a 3/2 directional valve 61.

Figure 2:
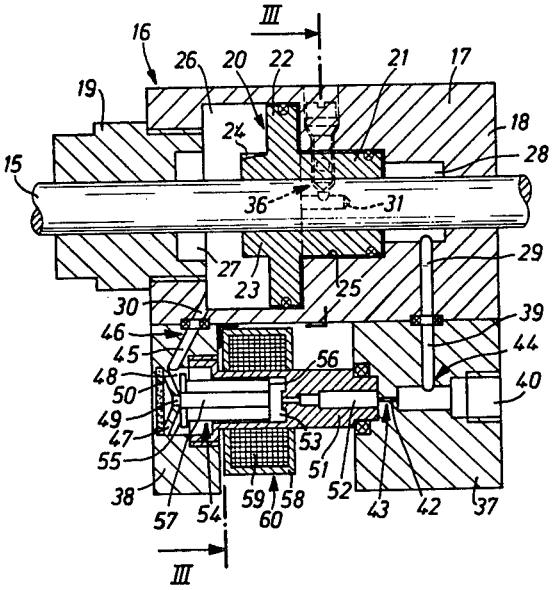
FIG. 2 is a sectional view of the air cylinder and the directional valve.

The device operates as follows:

With the sewing machine both switched on and switched off, bore 40 is connected to compressed air source 41. Consequently, small cylinder space 25 and small piston portion 21 are permanently under pressure, through conduit 44. During a sewing operation, and with the sewing machine stopped, electromagnet 60 is de-energized. Therefore, valve piston 54 is held by the compressed air in its left-hand position as shown in FIG. 2, in which bore 52 is cleared by front face 56, and bore 49 is closed by front face 55. In this position of valve piston 54, large cylinder space 26 and large piston portion 22 are under pressure through conduit 46. The compressed air acting on both sides of piston 20 produces on piston portions 21,22 opposite forces whose magnitudes correspond to the surface ratio. In the view of FIGS. 1 and 2, the force acting toward the right-hand side exceeds thus more than twice the force acting toward the left-hand side, so that portion 20 is securely held in its right-hand position. In this way, thread catcher 6 is also firmly held in its rest position.

At the end of each seam, the sewing machine, controlled by a synchronizer (not shown), is stopped with needle 4 in the upper dead center position. Thread cutter 5 is then released, for example by actuating a foot rocker. This causes one revolution of the main shaft of the sewing machine. During this revolution, about in the lower dead center position of needle 4, electromagnet 60 is energized so that valve piston 54 is pulled to the right. This closes bore 52 and clears bore 49, whereupon cylinder space 26 is vented through bores 30, 45, chamber 48, bore 49, and disc 50 of sintered metal.

Since bores 30, 45 and 49 have a relatively large cross-sectional area of flow, cylinder space 26 is vented very quickly. Consequently, piston 20, which continues to be under pressure from the right-hand side, through conduit 44 which again has a large cross-sectional area of flow, can also be moved very quickly to the left. Since at the right-hand side of piston 20, no building up of pressure is needed at the start of the thread cutting operation, as the full pressure has permanently been applied, piston 20 is capable of overcoming without delay even larger resistances to motion, such as caused by static friction.

Toward the end of the motion of piston 20 to the left, damping piston 23 plunges into damping bore 27. The compression of air in damping bore 27, thus the formation of an air cushion, retards the piston. Through notch 24, the air cushion can expand, so that an excessive pressure rise and thus a reversal of the motion of piston 20 are eliminated. While being displaced to the left, piston rod 15 moves thread catcher 6, through link 14, angle lever 12 and link 11, into the needle thread loop which has been engaged and enlarged by rotary hook 3, and takes hold of the needle thread loop portion leading to the work, as well as of the bobbin thread.

Upon stopping the sewing machine in the upper dead center position of needle 4, electromagnet 60 is de-energized through a timing circuit, and valve piston 54 is returned by the compressed air into the position shown in FIG. 2, in which bore 52 is cleared by front face 56 and bore 49 is closed by front face 55. As bore 52 is cleared, cylinder space 26 is pressurized again through conduit 46. Because of throttle 43, a pressure can build up in cylinder space 26 only relatively slowly. As soon as the force acting on large piston portion 22 exceeds the opposite force acting on small piston portion 21, piston 20 starts moving to the right. Thereby, the air taken earlier through throttle valve 36 into the portion of cylinder space 26 at the right-hand side of piston portion 22 is initially compressed and then displaced again through throttle valve 36, so that the movement of piston 20 is braked.

Throttle 43 in conduit 46 and throttle valve 36 in conduit 35 thus produce the effect that piston 20 returns into its initial position 3 at a relatively slow speed. Therefore, thread catcher 6 is also returned to its rest position at a reduced speed. During this return, it pulls the needle and bobbin threads off in a length corresponding to the extent of its travel, and moves them to cutting knife 7 by which the threads are cut through at the end of this step of motion.

Since the second step of motion of thread catcher 6 is effected at a reduced speed, there is no chance that thin and sensitive threads would tear during the thread pulling operation. Piston 20 is moved back against the flow resistance produced by throttle valve 36, so that the full pressure builds up in cylinder space 26 at the left-hand side remote from piston portion 21. Therefore, due to the surface area ratio of piston portions 21,22, a force more than twice as strong is exerted by piston 20 during its motion toward the right, into its rest position, than in the opposite direction. This makes sure that even thick threads will be satisfactorily cut.

While a specific embodiment of the invention has been shown and described in detail to illustrate the application of the principles of the invention, it will be understood that the invention may be embodied otherwise without departing from such principles.

What is claimed is:

1. A thread cutting device for sewing machines which have a thread catcher with a thread engaging arm which is movable to engage the thread and bring it up to a knife for severing of the thread, comprising a piston which is movable in a first step of motion to cause the support arm of the thread catcher to move in a first step of motion to take hold of the thread and a second step of motion in an opposite direction to pull the thread out and move it to a fixed knife, a double acting cylinder having a large diameter portion, and a small diameter portion smaller than said large diameter portion, a piston movable in said cylinder to move the thread having a large diameter portion in the large diameter portion of said cylinder and a smaller diameter portion in the smaller diameter portion of said cylinder, said piston smaller diameter portion serving to effect the first step of motion in said piston large diameter portion serving to effect the second step of motion, means venting said cylinder on its end adjacent said smaller diameter portion, and means for alternately pressuring and venting said large diameter portion on its end opposite from said small diameter portion, said means including a conduit having a throttle therein.

2. A thread cutting device according to claim 1, wherein said cylinder has a damping cylinder portion on the side of said large diameter portion opposite to said small diameter portion, said piston includes a damping piston portion movable in said damping cylinder.

3. A thread cutting device according to claim 1, wherein said means for alternately pressurizing and venting said large diameter cylinder includes a connection to the large diameter portion of said cylinder which extends to said smaller diameter cylinder and having a directional valve therein formed intricately with said cylinder.

4. A thread cutting device according to claim 1, including conduit means extending between said large diameter portion of said cylinder and said small diameter portion of said cylinder, a directional valve connected in said conduit means, said directional valve including an end portion having a venting bore in a conduit connected between said end portion and said large diameter cylinder space, said directional valve including a directional valve piston having a sealing face at each end movable in a valve cylinder, a compressed air supply conduit connected into said cylinder, said sealing faces of said valve alternately closing the supply conduit and said venting bore, said valve having a valve piston with a flow channel extending the entire length thereof.

5. A thread cutting device according to claim 4, wherein said directional valve has a 3/2 directional valve operation having a flow through zero position, and electromagnetic means for operating said piston of said valve.

* * * * *